US006339931B1

(12) United States Patent
Cull

(10) Patent No.: US 6,339,931 B1
(45) Date of Patent: Jan. 22, 2002

(54) METHOD FOR CHARGING A SELF-CHILLING BEVERAGE CAN

(75) Inventor: David Cull, St. Charles, IL (US)

(73) Assignee: Penguin Plastics Inc., Rolling Meadows, IL (US)

( * ) Notice: Subject to any disclaimer, the term of this patent is extended or adjusted under 35 U.S.C. 154(b) by 0 days.

(21) Appl. No.: 09/580,135

(22) Filed: May 30, 2000

(51) Int. Cl.[7] ..... F25B 45/00
(52) U.S. Cl. ..... 62/77
(58) Field of Search ..... 62/77, 293, 294, 62/60

(56) References Cited

U.S. PATENT DOCUMENTS

| | | | | |
|---|---|---|---|---|
| 3,852,975 | A | 12/1974 | Beck | 62/294 |
| 3,919,852 | A | 11/1975 | Jones | 62/7 |
| 3,919,856 | A | 11/1975 | Beck | 62/60 |
| 4,380,157 | A | 4/1983 | Christiani | 62/315 |
| 5,331,817 | A | 6/1994 | Anthony | 62/5 |
| 5,394,703 | A | 3/1995 | Anthony | 62/5 |
| 5,609,038 | A | 3/1997 | Halimi | 62/294 |
| 5,692,391 | A | 12/1997 | Joslin, Jr. | 62/293 |

*Primary Examiner*—William Doerrler
*Assistant Examiner*—Malik N. Drake
(74) *Attorney, Agent, or Firm*—Dick and Harris

(57) ABSTRACT

The present invention is directed to a method for charging a self-chilling beverage can, in a self-chilling beverage can of the type involving a container-within-container construction wherein, for example, a granular carbon material is contained within the inner container, and charged with a gas that is absorbed into the carbon material under pressure, the beverage being placed into the space between the inner and outer containers, and further whereupon release of the charging gas, the temperature of the carbon material drops rapidly, enabling a transfer of heat from the contained beverage through the wall of the inner container into the carbon material. The present invention is directed to a method for providing accelerated charging of the charging gas into the inner container, while absorbing and/or transporting away heat generated by the compression of the charging gas. The invention is also directed to an apparatus for facilitating charging of such a self-chilling container.

The present invention is also directed to a self-heating container.

8 Claims, 6 Drawing Sheets

METHOD FOR CHARGING A SELF-CHILLING BEVERAGE CAN

BACKGROUND OF THE INVENTION

1. Field of the Invention

The present invention relates to self-chilling beverage containers.

2. The Prior Art

Self-chilling beverage and food containers are known. Typically, the overall container is of the type in which there is a container within container construction, to create separate, inner and outer containment regions. A coolant material is placed in one of the regions, and the material (e.g., beverage) to be cooled is placed in the other of the regions. The coolant material may be placed in the innermost container, typically, although it may be placed in the space between the inner and outer container walls. The coolant material may comprise a compressed gas material, with or without another material. When the entire container, including the coolant material and the beverage, is at ambient temperature, release of the compressed gas material results in an endothermic reaction that causes rapid heat transfer from the beverage into the region formerly occupied by the compressed gas. This causes the beverage to be rapidly cooled.

Several such devices are known in the prior art.

Beck, U.S. Pat. No. 3,852,975 and U.S. Pat. No. 3,919,856, for example, disclose self-chilling containers in which an inner chamber contains a pressurized refrigerant, preferably Freon.

Halimi, U.S. Pat. No. 5,609,038, discloses a self-chilling beverage container, which uses compressed carbon dioxide gas, as the refrigerant material.

Anthony, U.S. Pat. No. 5,394,703, discloses a self-chilling food or beverage container, which employs a refrigerant gas, and a vortex tube in the heat exchange unit, which causes a portion of the refrigerant to be recondensed and returned to the coolant reservoir, to provide for elongated cooling period.

Joslin, Jr., U.S. Pat. No. 5,692,391, discloses a self-chilling beverage container that uses a refrigerant that is a combination of at least one liquefied petroleum gas and a halogen gas.

In each of these prior art embodiments, only a refrigerant gas is used, with no additional material, in an inner coolant reservoir. Accordingly, once the gas has been released, the container immediately beings to reheat from ambient, as the emptied inner container or cartridge has relatively little thermal inertia, and little capacity for further absorbing heat.

An improved version of the self-chilling can has been developed and marketed as the Chill-Can® which is believed to have been developed from a British Oxygen Company Limited originally patented design, and subsequently marketed by Chill-Can N.V. In this particular self-chilling beverage container, a first inner container, having an opening at one end, is inserted into and sealingly affixed, at the periphery of the open end, to the periphery of one end of a double-open-ended outer container.

A quantity of solid carbon material, including graphite, is placed in the inner container. An actuating valve covers the open end of the inner container. The charging gas, preferably $CO_2$ gas, is then loaded into the inner container, using the well-known "equilibrium filling" technique.

However, it is known that in order to put sufficient $CO_2$ gas into the inner container, pressures are required that are so high that considerable heat is created during the filling process. While the initial step of the filling process may place 50%–70% of the required gas into the cylinder, the heat generated makes it difficult to quickly continue to fill the chamber. Accordingly, it becomes necessary to pause in the filling process, so that heat is dissipated from the inner container's carbon content, to permit filling to resume. A conventional equilibrium filling procedure, for such a self-chilling container can take up to 10 to 15 minutes. Such an excessive filling time is completely inadequate for the kind of high-speed mass production rates desired for beer and soft drink manufacture and distribution.

Indeed, even the simpler, prior art charged compressed gas self-chilling containers suffer from this drawback.

Accordingly, it would be desirable to provide a method for accelerated filling of the coolant reservoirs for self-chilling beverage and food containers.

It would also be desirable to provide an apparatus for accelerated filling of the coolant reservoirs for self-chilling beverage and food containers.

These and other desirable characteristics of the present invention will become apparent in view of the present specification, including claims, and drawings.

SUMMARY OF THE INVENTION

The present invention comprises, in part, a method for charging of a heat exchange unit for a self-chilling container, wherein the self-chilling container includes an outer tubular member, an inner heat exchange unit that includes an inner closed end tubular container, and a volume therebetween for the containment of a consumable material, the inner heat exchange unit further including a closure and coolant release valve structure connected to an open end of the closed end tubular container, opposite the closed end of the closed end tubular container, the inner heat exchange unit further including a first heat exchange medium disposed in the closed end tubular container and operably configured for absorbing, under pressure, a second heat exchange medium, whereupon actuation of the closure and coolant release valve structure, the second heat exchange medium is released in gaseous form from the inner heat exchange unit, resulting in a release of heat from the inner heat exchange unit, so that heat is transferred from the consumable material into the inner heat exchange unit, the method comprising:

- providing a filling machine, having at least one filling head operably connected to a source of second heat exchange medium;
- the filling machine further having at least one refrigerant adapter operably connected to a source of refrigerant material;
- inserting the partially constructed self-chilling container structure into the filling machine;
- supplying refrigerant to the at least one refrigerant adapter, operably configured to deliver refrigerant into the partially constructed self-chilling container, to substantially surround the inner heat exchange unit,
- positioning a filling head in juxtaposed relation to the closure and coolant release valve structure of the partially constructed self-chilling container;
- supplying second heat exchange medium to the inner heat exchange unit of the partially constructed self-chilling can to at least partially charge the inner heat exchange unit.

According to a preferred embodiment of the invention, the method may further comprise the steps of:

mounting a partially constructed self-chilling container onto a supporting puck, the supporting puck being operably configured to mate with the at least one refrigerant adapter, to enable refrigerant supplied to the at least one refrigerant adapter to be received through the supporting puck into a coolant passage structure operably configured to surround the inner heat exchange unit of the partially constructed self-chilling container;

mating the at least one refrigerant adapter with the supporting puck.

The step of supplying refrigerant may further comprise the step of supplying refrigerant to the at least one refrigerant adapter and into the coolant passage.

The method may further comprise the steps of:

disengaging the filling head from the partially constructed self-chilling container;

disengaging the at least one refrigerant adapter from the supporting puck, leaving a quantity of refrigerant in the supporting puck to continue to absorb heat from the inner heat exchange unit of the partially self-chilling container.

The method may further comprise the steps of:

further successively charging the inner heat exchange unit of the partially constructed self-chilling container, until the inner heat exchange unit has received a quantity of second heat exchange medium to chill the consumable material in the self-chilling container, upon subsequent completion of construction of the self-chilling container and actuation of the closure and coolant release valve structure.

The present invention also comprises in part, an apparatus for charging of a heat exchange unit for a self-chilling container, wherein the self-chilling container includes an outer tubular member, an inner heat exchange unit that includes an inner closed end tubular container, and a volume therebetween for the containment of a consumable material, the inner heat exchange unit further including a closure and coolant release valve structure connected to an open end of the closed end tubular container, opposite the closed end of the closed end tubular container, the inner heat exchange unit further including a first heat exchange medium disposed in the closed end tubular container and operably configured for absorbing, under pressure, a second heat exchange medium, whereupon actuation of the closure and coolant release valve structure, the second heat exchange medium is released in gaseous form from the inner heat exchange unit, resulting in a release of heat from the inner heat exchange unit, so that heat is transferred from the consumable material into the inner heat exchange unit.

The apparatus comprises, in a preferred embodiment, a filling machine, having at least one filling head operably connected to a source of second heat exchange medium. At least one refrigerant adapter may be operably connected to a source of refrigerant material. The filling machine may further be operably configured to receive at least one partially constructed self-chilling container.

Means are provided for bringing the at least one partially constructed self-chilling container into operable connection with the at least one refrigerant adapter. Means are also provided for delivering refrigerant into the at least one partially constructed self-chilling container, to substantially surround the inner heat exchange unit.

At least one filling head is operably positionable in juxtaposed relation to the closure and coolant release valve structure of the partially constructed self-chilling container;

Means are provided for supplying second heat exchange medium to the inner heat exchange unit of the partially constructed self-chilling can to at least partially charge the inner heat exchange unit.

The apparatus may further comprise a supporting puck, for supporting a partially constructed self-chilling container, and operably configured to mate with the at least one refrigerant adapter, to enable refrigerant supplied to the at least one refrigerant adapter to be received through the supporting puck into a coolant passage structure operably configured to surround the inner heat exchange unit of the partially constructed self-chilling container.

The present invention is also directed to a self-heating container for a consumable product, comprising:

an outer consumable material container;

an inner heat exchange unit, including an outer heat exchange shell and an inner frangible membrane, the inner frangible membrane breachably dividing an interior volume of the outer heat exchange shell into a first region and a second region;

a rupture device, operably associated with the inner heat exchange unit and the inner frangible membrane, operably configured to selectively breach the membrane, to place the first and second regions into communication with one another;

a first reactant material stored in the first region;

a second reactant material stored in the second region;

the first and second reactant materials being selected from those materials that are separately and upon reaction with one another, non-toxic, and which produce an exothermic reaction when in each other's presence.

DETAILED DESCRIPTION OF THE DRAWINGS

Figure 1:
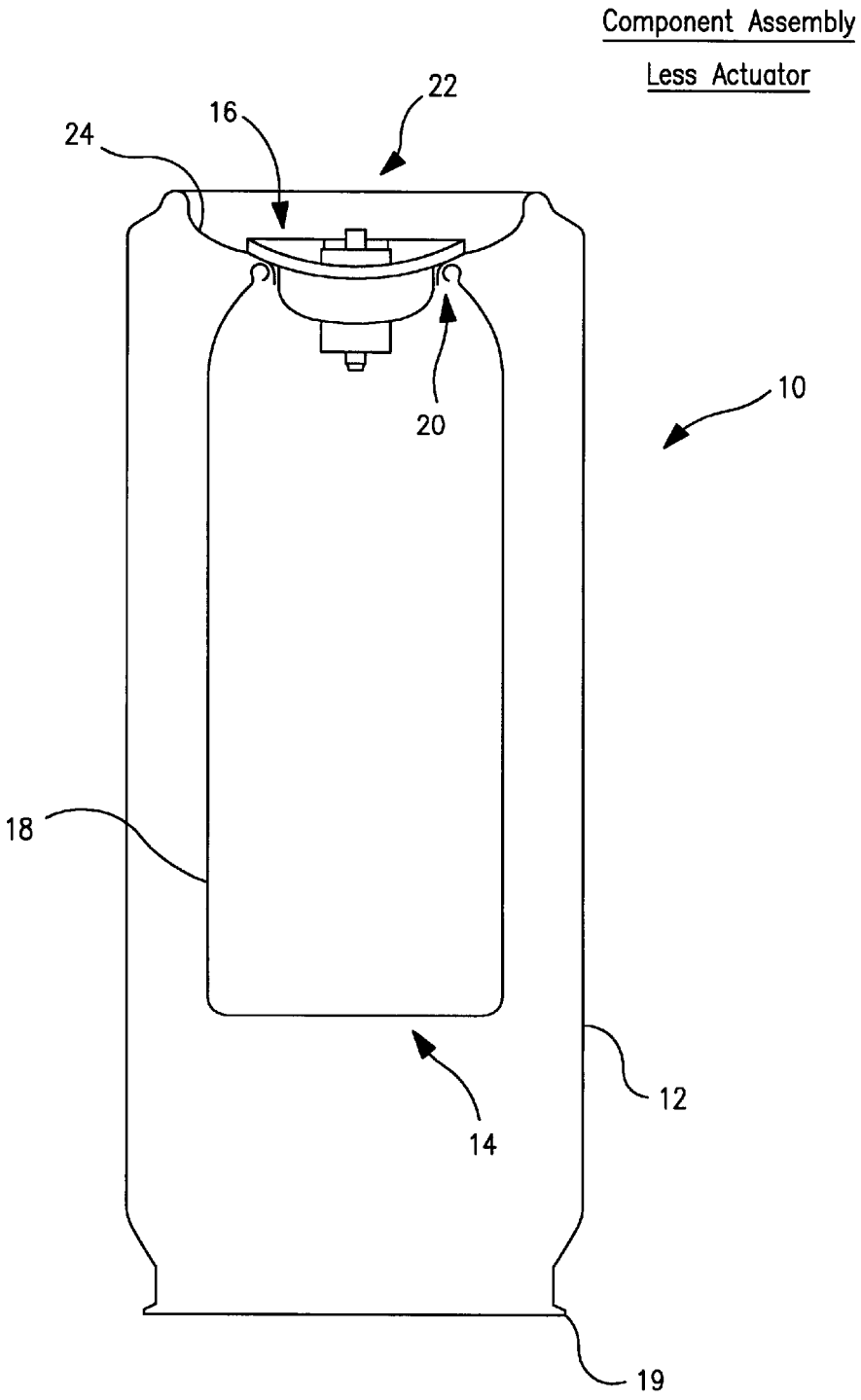
FIG. 1 is a side elevation, in section, of a self-chilling beverage container; the coolant reservoir of that may be advantageously filled using the method, apparatus and principles of the present invention.

While this invention is susceptible of embodiment in many different forms, there is shown in the drawings and will be described in detail, a specific embodiment, with the understanding that the present disclosure is to be considered as an exemplification of the principles of the invention and is not intended to limit the invention to the embodiment illustrated.

FIG. 1 is a side elevation, in section, of a self-chilling beverage can, of the type known commercially as the Chill-Can®, which is shown in a partially completed state.

Beverage can 10 includes an outer tubular member 12, a heat exchange unit (HEU) 14, and a combination closure and coolant release valve structure 16. HEU 14 includes a closed end tubular container 18, which has an open end 20 that is sealingly connected to an opening 22 in the concave end 24 of tubular outer member 12. The actuator structure for the closure and coolant release valve structure 16 has been omitted from the illustration, but such structures are well known, and illustration of same is not required for a complete understanding of the present invention. Also omitted from the illustration is the carbon material that would be placed in the bottom of closed end tubular container 18, prior to attachment of tubular container 18 to opening 22, or, at any rate, prior to placement of closure and coolant release valve structure 16.

Can 10 is shown in FIG. 1, prior to the attachment of the top of the can (which would be affixed to the "bottom" of the open tubular member 12, as seen in FIG. 1) to the "top" edge 19 of outer tubular member 12. Charging of the HEU 14 occurs through closure and coolant release valve structure 16, prior to attachment of the can top, and prior to the attachment of the actuator structure.

In prior art procedures for charging the HEU's of such cans, a rotary filling machine is used. Such machines are generally well known in the art, and can be obtained from manufacturers such as Terco, Inc. of Bloomingdale, Ill.; KP/Aerofill of Davenport, Iowa; and Pamasol of Switzerland. In such a machine, the cans are set, in the orientation shown in FIG. 1, onto solid "pucks". Each puck has a circumferential notch or ridged portion, onto which the can is set and supported, to provide structural support for the can, while a filling nozzle descends from above and engages the closure and coolant release valve structure, to inject coolant under pressure. As previously mentioned, while the initial charging can occur relatively quickly, and accomplishes a substantial percentage of the charging of the HEU, substantial heat is generated during this process. Typically, the partially charged cans must then be taken off the rotary filling machine, and put in a waiting area to cool, for the next successive filling steps. As indicated above, this process can occupy several minutes, and creates a substantial "bottleneck" in the production line.

In accordance with the principles of the present invention, it has been determined that if the HEU is surrounded by a coolant material, during and following the initial charging step, then the filling process can be accelerated considerably.

Figure 2:
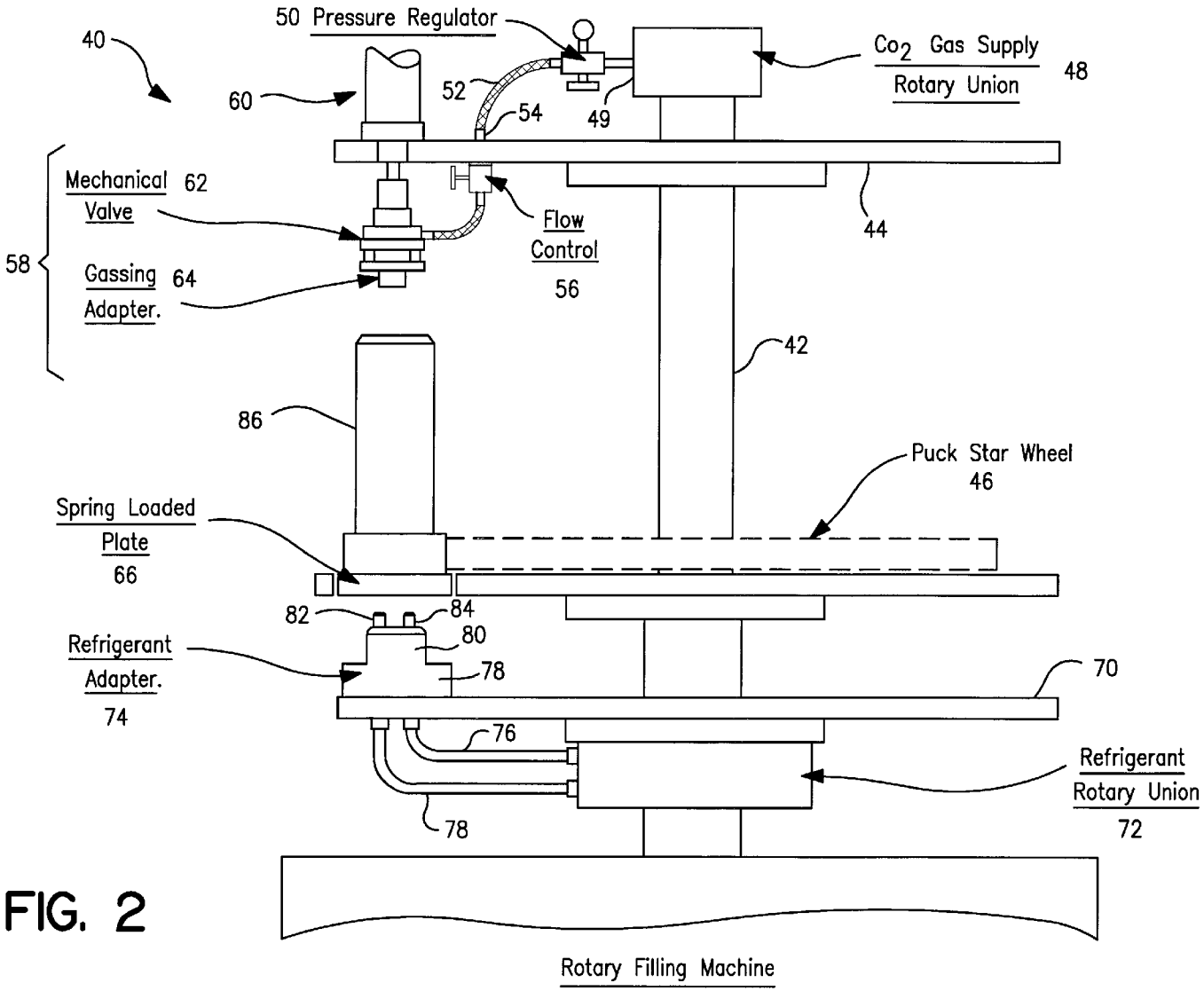
FIG. 2 is a schematic side elevation of a rotary filling machine, for charging the coolant reservoirs of self-chilling beverage containers, in accordance with the principles of the present invention.

FIG. 2 illustrates schematically, a rotary filling machine, that has been modified in accordance with the principles of the present invention. Filling machine 40 has a central shaft 42, an upper filling wheel 44 and a puck star wheel 46. The filling and can holding equipment, described hereinafter, is provided for each can holding position on the filling machine. As these components are radially and circumferentially symmetrically distributed about the circumference of the wheels, only one such filling station on the wheel is shown in FIG. 2, for simplicity of illustration. A charging gas supply rotary union 48, which may be of conventional configuration, is positioned at the top of the central shaft. In this rotary union 48, a plurality of gas outlets 49 is provided, each having its own pressure regulator 50. A corresponding hose connection 52 connects to a fitting/aperture 54 in wheel 44. A further flow control device 56, such as a needle valve, is connected to the fitting 54 in wheel 44, and leads via another hose to a filling head 58, suspended from the wheel 44 at each filling position. Each filling head 58 is vertically movable, for example by a pneumatic piston and cylinder arrangement 60. Each filling head 58 further includes a mechanical valve 62 and gassing adapter 64. Puck star wheel 46 will be provided with a plurality of radially outwardly opening arcuate slots, into which the bases of the pucks are received and held. Beneath the puck star wheel 46 is an upwardly biased spring loaded plate 66, which vertically supports the pucks as they are rotated around the filling machine. To the extent thus far described, these elements are common to prior art filling devices.

In practice, in a prior art machine as described so far, the can-laden pucks are continuously loaded into the filling machine, and as the wheels rotate, each filling head descends and engages the closure and coolant release valve structure of the can beneath. An initial filling procedure takes place as the wheels continue to rotate, and then after the initial filling procedure is completed, the cans are ejected from the machine, after nearly a complete rotation has taken place. However, in a prior art machine, this initial filling procedure may accomplish only a fraction of the filling that is required, and many minutes must be wasted in cooling down the cans, before further filling can take place.

However, as shown in FIG. 2, filling machine 40 has been further modified, to include a further rotating wheel 70. Beneath and connected to wheel 70 is refrigerant rotary union, which may be provided with a suitable source of coolant, as further described hereinafter, as well as suitable rotary union connections, as may be provided by one of ordinary skill in the art having the present disclosure before them. On wheel 70 is provided a plurality of refrigerant adapters 74, each of which is connected by an inlet tube 76 and an outlet tube 78 to refrigerant rotary union 72. Each adapter 74 includes a substantially cylindrical base 78, a cylindrical mating portion 80, and two refrigerant fittings 82, 84, which are configured to be insertingly received into refrigerated puck 86, in a manner to be described in further detail herein.

Figure 3:
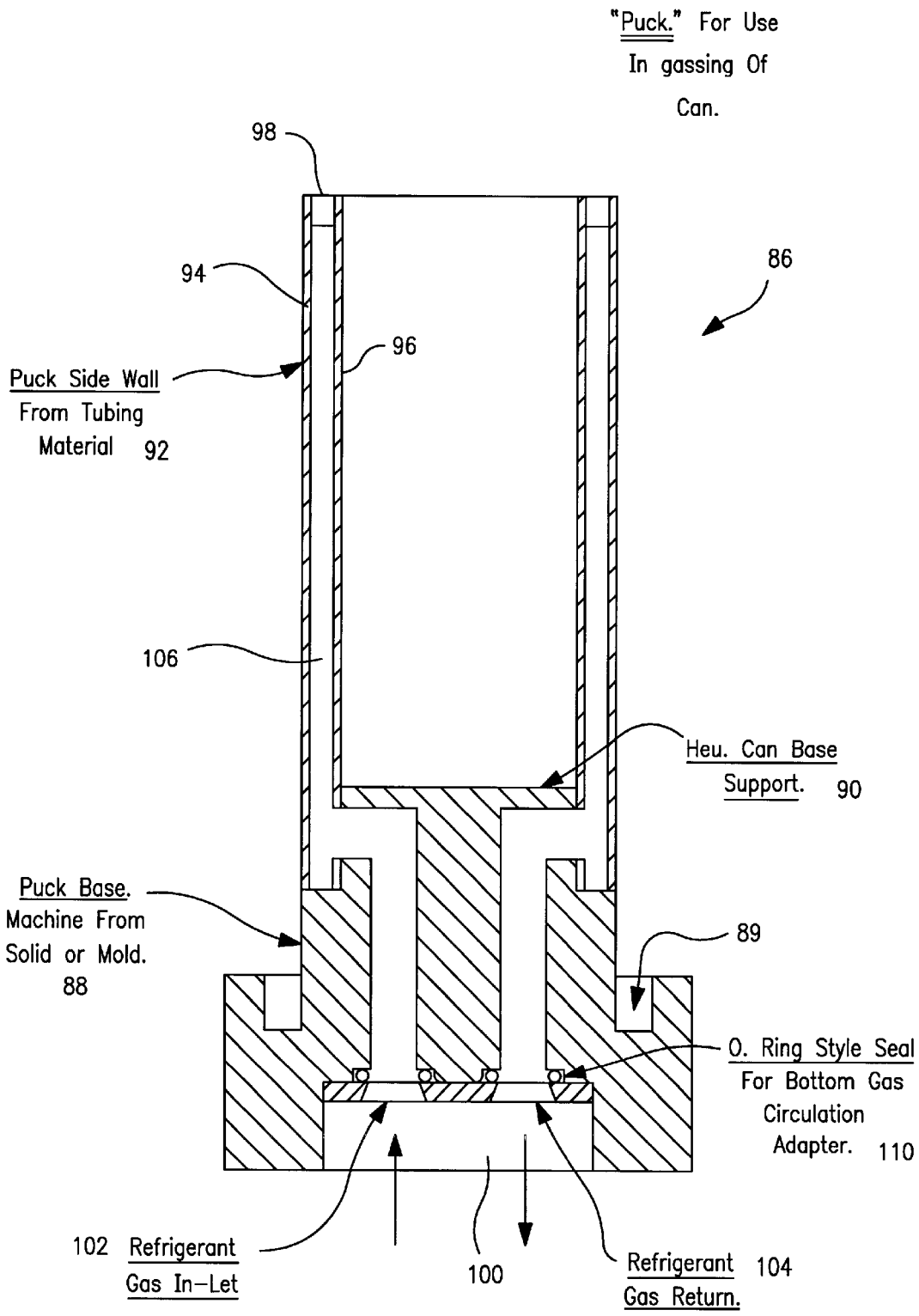
FIG. 3 is a side elevation, in section, of a container supporting puck, for use with a filling machine, for charging the coolant reservoirs of self-chilling beverage containers, in accordance with the principles of the present invention.
Figure 4:
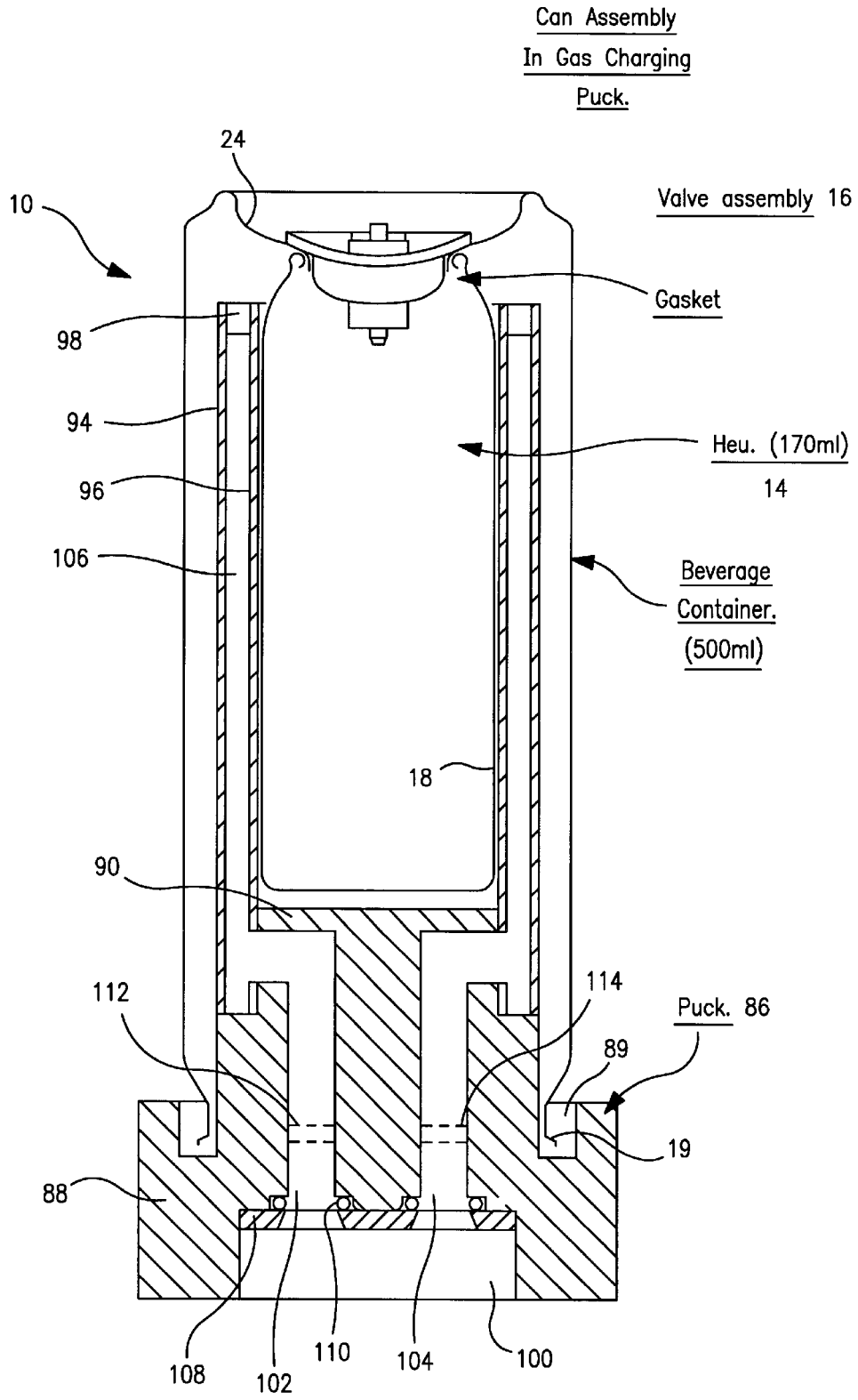
FIG. 4 is a side elevation, in section, of a container supporting puck, with a container in place on the puck, for use with a filling machine, for charging the coolant reservoirs of self-chilling beverage containers, in accordance with the principles of the present invention.
Figure 5:
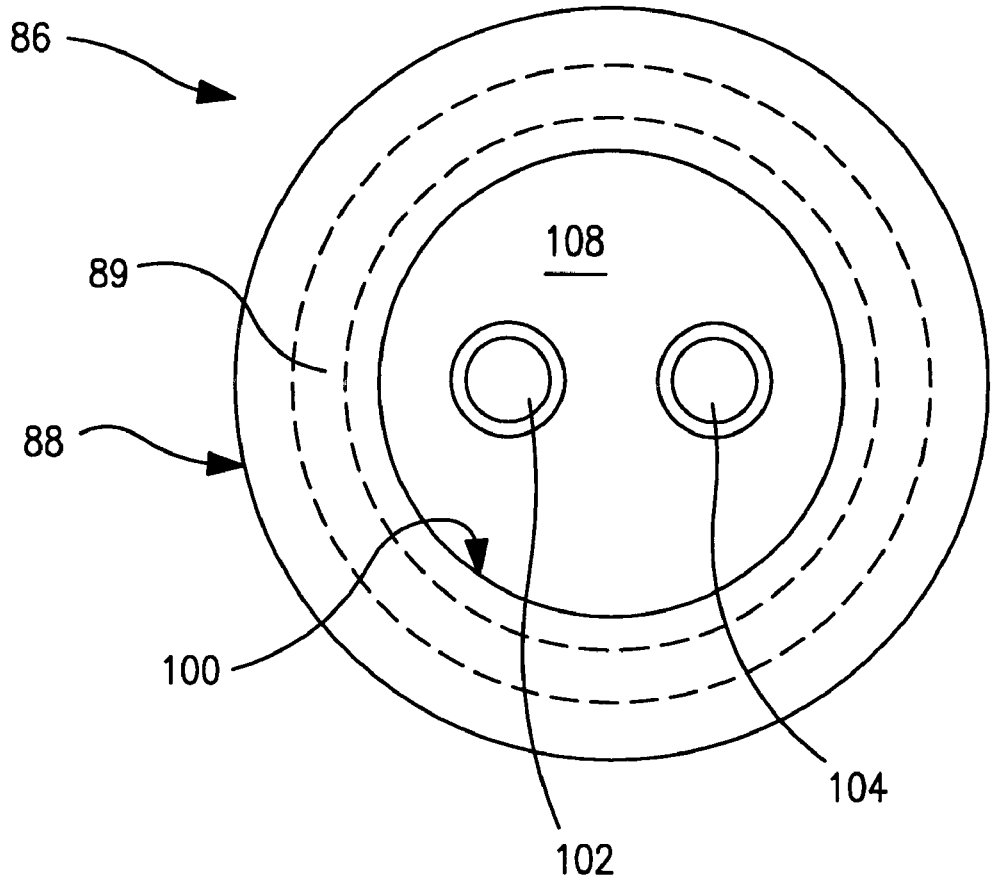
FIG. 5 is a bottom view of the container supporting puck of FIGS. 3 and 4, according to the principles of the present invention.

FIGS. 3, 4 and 5 illustrate the refrigerated puck 86, intended to be used, in accordance with the principles of the present invention, with rotary filling machine 40. Each refrigerated puck 86 includes a base 88, that may preferably be machined or cast from solid metal, such as aluminum, or an aluminum-copper alloy, or even a suitable plastic material that is capable of performing adequately, under the kinds of filling conditions described herein. Base 88 includes an annular recess 89, which is configured to insertingly receive the open end of a self-chilling can, corresponding to the "top" of the ultimately filled and sealed can. Extending upwardly from base 86 is HEU (heat exchange unit) support base 90. Puck sidewall 92 includes outer cylindrical wall 94 and inner cylindrical wall 96. Similarly, walls 94 and 96 may be metal, or suitable plastic material. Walls 94 and 96 are connected at their respective top edges by annular ring 98. Sidewall 94 is connected at its bottom edge to puck base 88, while sidewall 96 is connected at its bottom edge to the circumferential side surface of HEU can base support 90. A cylindrical recess 100 extends upwardly into the bottom of puck base 86. Vertically extending refrigerant gas inlet 102 and refrigerant gas outlet 104 connect, at opposite locations on the circumference of puck sidewall 92, to annular cylindrical coolant passage 106.

FIG. 4 shows a can 10 in position on puck 86, awaiting charging of the HEU. The "top" edge 19 of outer tubular member 12 is nestingly received in recess 89. HEU 14 is nestingly received in the top of puck 86, inside puck sidewall 92. Preferably, the dimensions of the interior of the top of puck 86 are selected so that HEU 14 fits very closely, but not bindingly, so that the cans may be readily inserted and removed from the pucks, at the appropriate positions along the manufacturing line. Puck 86 also includes gasket member 108, and O-ring seals 110.

In accordance with the principles of the invention, the charging process may occur as follows (with reference to FIGS. 2–4): 1) cans 10 that have been placed on pucks 86 (using conventional handling mechanisms) will be inserted into slots in puck star wheel 46 (again using conventional handling mechanisms). As the star wheel 46 rotates, a filling head 58 will descend upon the "bottom" end of a can 10. The top pressure being applied by the filling head 58 to the "bottom" of the can will cause the spring loaded base plate 66 to be lowered. The bottom of the puck 86 will engage the refrigerant adapter 74 making contact with the recess 100 of puck 86. Inlet fitting 82 and outlet fitting 84 will be inserted into puck inlet 102 and puck outlet 104. From a source of refrigerant (e.g., liquid nitrogen—not shown), refrigerant will be supplied to union 72, flow through connection 78, enter puck 86 and fill passage 106. At the same time, HEU charging gas, under pressure, will be supplied from filling head 58 into HEU 14, the charging gas being compressed into a liquid in the process. The heat developed during the charging procedure, will be conducted through the sidewalls of closed end tubular container 18, through the inner cylindrical wall 96 and carried away by the refrigerant.

In a preferred embodiment of the invention, each of inlet 102 and outlet 104 of puck 86 may be provided with one-way valves 112, 114 (which may be of conventional configuration), that are held open when fittings 82 and 84 are inserted into puck 86. In this way, as each puck 86 has completed its circuit during a rotation of star wheel 46, as the filling head 58 is raised from the gassing position the spring loaded base plate 66 returns to its at-rest position. This action removes the respective refrigerant adapters 74 from the respective pucks 86. Upon separation, the one-way valves 112, 114 prevent the escape of the liquid refrigerant, which remains in the puck passage 106, continuing to prompt the transfer of generated heat from the HEU 14 into the refrigerant.

Using the aforementioned process, the heat generated by the charging process is contemporaneously removed from the HEU, thus permitting the accelerated charging of the HEU. While it may not be possible to achieve complete charging of the HEU in a single step, it is contemplated that the individual cans may proceed to a subsequent charging station (which may be provided with its own wheel 70 with refrigerant rotary union 72 and refrigerant adapters 74), with considerably less than the 10–15 minute cooling off period required by prior art systems. Instead, it is contemplated that a delay of only 10–20 seconds may be required, before charging can be resumed.

Figure 6:
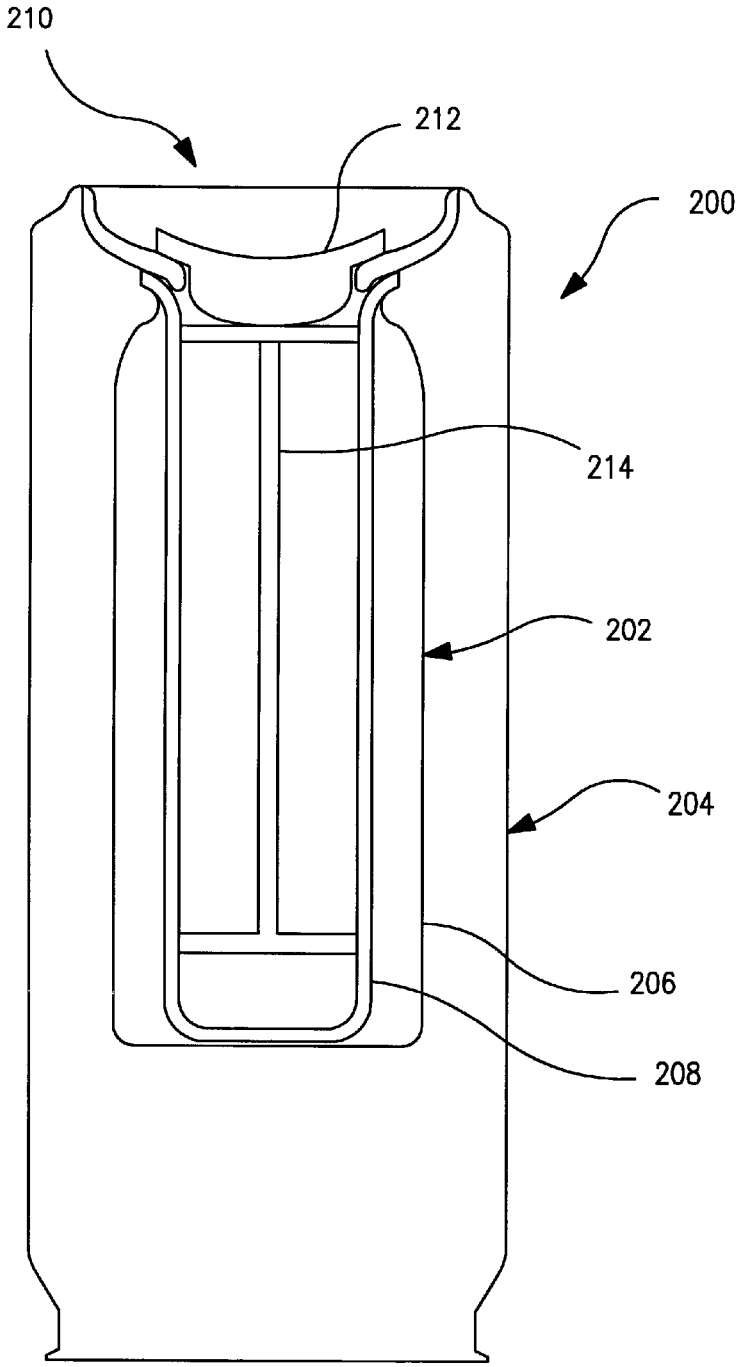
FIG. 6 is an illustration of a self-heating container.

The present invention is also directed to a self-heating container, shown in FIG. 6. Self-heating container 200 comprises inner heat exchange unit 202 and outer container 204. Container 200 is shown, minus the conventional ring-pull top, that would be attached to the "top" of outer container 204 (the bottom of container 204 as shown in FIG. 6).

Heat exchange unit 202 comprises an outer heat transfer shell 206, an inner frangible diaphragm 208, and rupture device 210, that includes actuator button 212 and rupture stem 214.

Contained within inner frangible diaphragm 208 is a volume of a first reactive material, e.g., water. Contained between shell 206 and container 208, is a second reactive material, e.g. zeolite (please provide a brief explanation of the material). Contained between container 204 and container 206 is a consumable material, that is intended to be consumed hot, such as soup, coffee, etc.

The principle behind the operation of container 200 is that it takes advantage of the existence of certain known chemical reactions, such as between water and zeolite, that is exothermic. The reactive materials must be non-toxic, both separately, and in their reaction byproducts, so that any possible leakage or cross-contamination does not have dangerous consequences. Upon actuation of the actuator 212, stem 214 (which may be of any suitable configuration to accomplish the desired result) ruptures membrane 208, causing the two reactive materials to mix, leading to the desired reaction. Heat is transferred out of heat exchange unit 202, and into the consumable product.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A method for charging of a heat exchange unit for a self-chilling container, wherein the self-chilling container includes an outer tubular member, an inner heat exchange unit that includes an inner closed end tubular container, and a volume therebetween for the containment of a consumable material, the inner heat exchange unit further including a closure and coolant release valve structure connected to an open end of the closed end tubular container, opposite the closed end of the closed end tubular container, the inner heat exchange unit further including a first heat exchange medium disposed in the closed end tubular container and operably configured for absorbing, under pressure, a second heat exchange medium, whereupon actuation of the closure and coolant release valve structure, the second heat exchange medium is released in gaseous form from the inner heat exchange unit, resulting in a release of heat from the inner heat exchange unit, so that heat is transferred from the consumable material into the inner heat exchange unit, the method comprising:

providing a filling machine, having at least one filling head operably connected to a source of second heat exchange medium;

the filling machine further having at least one refrigerant adapter operably connected to a source of refrigerant material;

inserting the partially constructed self-chilling container structure into the filling machine;

supplying refrigerant to the at least one refrigerant adapter, operably configured to deliver refrigerant into the partially constructed self-chilling container, to substantially surround the inner heat exchange unit, positioning a filling head in juxtaposed relation to the closure and coolant release valve structure of the partially constructed self-chilling container;

supplying second heat exchange medium to the inner heat exchange unit of the partially constructed self-chilling can to at least partially charge the inner heat exchange unit.

2. The method according to claim 1, further comprising the steps of:

mounting a partially constructed self-chilling container onto a supporting puck, the supporting puck being operably configured to mate with the at least one refrigerant adapter, to enable refrigerant supplied to the at least one refrigerant adapter to be received through the supporting puck into a coolant passage structure operably configured to surround the inner heat exchange unit of the partially constructed self-chilling container;

mating the at least one refrigerant adapter with the supporting puck.

3. The method according to claim 2, wherein the step of supplying refrigerant further comprises the step of supplying refrigerant to the at least one refrigerant adapter and into the coolant passage.

4. The method according to claim 2, further comprising the steps of:

disengaging the filling head from the partially constructed self-chilling container;

disengaging the at least one refrigerant adapter from the supporting puck, leaving a quantity of refrigerant in the supporting puck to continue to absorb heat from the inner heat exchange unit of the partially self-chilling container.

5. The method according to claim 4, further comprising the steps of:

further successively charging the inner heat exchange unit of the partially constructed self-chilling container, until the inner heat exchange unit has received a quantity of second heat exchange medium sufficient to chill the consumable material in the self-chilling container, to a desired amount, upon subsequent completion of construction of the self-chilling container and actuation of the closure and coolant release valve structure.

6. An apparatus for charging a heat exchange unit for a self-chilling container, wherein the self-chilling container includes an outer tubular member, an inner heat exchange unit that includes an inner closed end tubular container, and a volume therebetween for the containment of a consumable material, the inner heat exchange unit further including a closure and coolant release valve structure connected to an open end of the closed end tubular container, opposite the closed end of the closed end tubular container, the inner heat exchange unit further including a first heat exchange medium disposed in the closed end tubular container and operably configured for absorbing, under pressure, a second heat exchange medium, whereupon actuation of the closure and coolant release valve structure, the second heat exchange medium is released in gaseous form from the inner heat exchange unit, resulting in a release of heat from the inner heat exchange unit, so that heat is transferred from the consumable material into the inner heat exchange unit, the method comprising:

a filling machine, having at least one filling head operably connected to a source of second heat exchange medium;

at least one refrigerant adapter operably connected to a source of refrigerant material;

the filling machine being operably configured to receive at least one partially constructed self-chilling container, means for bringing the at least one partially constructed self-chilling container into operable connection with the at least one refrigerant adapter;

means for delivering refrigerant into the at least one partially constructed self-chilling container, to substantially surround the inner heat exchange unit;

at least one filling head, operably positionable in juxtaposed relation to the closure and coolant release valve structure of the partially constructed self-chilling container;

means for supplying second heat exchange medium to the inner heat exchange unit of the partially constructed self-chilling can to at least partially charge the inner heat exchange unit.

7. The apparatus according to claim 6, further comprising:

a supporting puck, for supporting a partially constructed self-chilling container, and operably configured to mate with the at least one refrigerant adapter, to enable refrigerant supplied to the at least one refrigerant adapter to be received through the supporting puck into a coolant passage structure operably configured to surround the inner heat exchange unit of the partially constructed self-chilling container.

8. A self-chilling container for a consumable product, comprising:

an outer consumable material container;

an inner heat exchange unit, including an outer heat exchange shell and an inner frangible membrane, the inner frangible membrane breachably dividing an interior volume of the outer heat exchange shell into a first region and a second region;

a rupture device, operably associated with the inner heat exchange unit and the inner frangible membrane, operably configured to selectively breach the membrane, to place the first and second regions into communication with one another;

a first reactant material stored in the first region;

a second reactant material stored in the second region;

the first and second reactant materials being selected from those materials that are separately and upon reaction with one another, non-toxic, and which produce an exothermic reaction when in each other's presence.

* * * * *